US007237481B2

(12) United States Patent
Joos

(10) Patent No.: US 7,237,481 B2
(45) **Date of Patent: *Jul. 3, 2007**

(54) DAMPENING SYSTEMS HAVING A DAMPENING AGENT FEEDING AND RETURN DEVICE

(75) Inventor: Wolfgang Joos, Speyer (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 231 days.

This patent is subject to a terminal disclaimer.

(21) Appl. No.: 10/513,795

(22) PCT Filed: Apr. 24, 2003

(86) PCT No.: PCT/DE03/01330

§ 371 (c)(1),
(2), (4) Date: Nov. 18, 2004

(87) PCT Pub. No.: WO03/097359

PCT Pub. Date: Nov. 27, 2003

(65) Prior Publication Data

US 2006/0162589 A1 Jul. 27, 2006

(30) Foreign Application Priority Data

May 18, 2002 (DE) ..... 102 22 294

(51) Int. Cl.
*B41L 23/00* (2006.01)

(52) U.S. Cl. ..... 101/148; 101/147; 101/350.5

(58) Field of Classification Search ..... 101/147, 101/148, 350.1, 350.5, 363, 364, 366
See application file for complete search history.

(56) References Cited

U.S. PATENT DOCUMENTS

| | | | | |
|---|---|---|---|---|
| 3,352,317 | A * | 11/1967 | Dahlgren | 137/339 |
| 5,303,652 | A * | 4/1994 | Gasparrini et al. | 101/425 |
| 5,735,204 | A | 4/1998 | Hara et al. | |
| 5,870,952 | A * | 2/1999 | Eichner et al. | 101/148 |
| 5,894,795 | A * | 4/1999 | Gagne et al. | 101/148 |
| 6,807,905 | B2 | 10/2004 | Deslangle et al. | |

FOREIGN PATENT DOCUMENTS

| | | |
|---|---|---|
| DE | 1 761 908 | 9/1971 |
| DE | 34 43 510 | 5/1986 |
| DE | 247 414 | 8/1987 |
| DE | 38 31 741 | 6/1989 |
| DE | 196 16 198 | 10/1997 |
| DE | 199 09 262 | 10/1999 |
| DE | 198 53 362 | 2/2000 |
| DE | 101 02 728 | 8/2001 |
| DE | 101 27 251 | 12/2002 |
| EP | 0 638 417 | 8/1994 |
| EP | 0 876 910 | 11/1998 |
| GB | 1235916 | 6/1971 |
| GB | 94 20 343.1 | 3/1995 |

* cited by examiner

*Primary Examiner*—Ren Yan
(74) *Attorney, Agent, or Firm*—Jones, Tullar & Cooper, P.C.

(57) ABSTRACT

A dampening system has at least one dampening ductor or roller; a dampening agent bin or trough, which holds a dampening agent, a feeding device, and a return device. The feeding device includes at least one dampening agent distributing pipe that has a number of spaced openings. A number of these dampening agent distributing pipes are assigned to the dampening ductor or roller.

52 Claims, 4 Drawing Sheets

DAMPENING SYSTEMS HAVING A DAMPENING AGENT FEEDING AND RETURN DEVICE

CROSS-REFERENCE TO RELATED APPLICATIONS

This patent application is the U.S. national phase, under 35 USC 371, of PCT/DE03/01330, filed Apr. 24, 2003; published as WO 03/097359 A1 on Nov. 27, 2003 and claiming priority to DE 102 22 294, filed May 18, 2002, the disclosures of which are expressly incorporated herein by reference.

FIELD OF THE INVENTION

The present invention is directed to dampening systems with devices for the inflow and for the return flow of a dampening agent. The dampening system includes at least one dampening ductor, a dampening agent tank, an inflow device and a return flow device.

BACKGROUND OF THE INVENTION

Dampening systems are used in offset printing presses and in other printing systems. A dampening system consists of, for example, a dampening ductor, which may also be called a water tank roller, a dampening agent tank, and devices for supplying and returning dampening agent to and from the dampening agent tank. The dampening ductor or roller is typically partially immersed in the dampening agent contained in the dampening agent tank, picks up the dampening agent by a rotating movement, and transfers the dampening agent to further rollers of the printing group. To prevent interferences with the printing operation, it is important that the dampening agent taken up by the dampening ductor or roller has identical physical and chemical properties over the entire length of the roller.

A dampening system in an offset printing press is described in DE 198 53 362 C1. A supply system for dampening agent, which has a plurality of spray nozzles over the roller length, is assigned to the dampening ductor in the axial direction of the ductor.

A dampening system is known from DE 196 16 198 A1, which system has at least one dampening agent pickup roller. A dampening agent supply line is arranged above the dampening agent pickup roller, parallel with this roller, and extends over the roller's full length. On its underside, the supply line is provided with outlet openings, by the use of which a water curtain is formed when the supply line is charged with dampening agent.

For use in removing deposits, such as ink particles, for example, from a dampening ductor or roller, DD 247 414 A1 proposes to press a stripping element against the surface of the roller with a pressure which is equal over the entire length of the roller.

A dampening agent recirculating system for offset printing presses is described in EP 0 638 417 A1. In this case, a dampening agent supply line, with hole-shaped cutouts, and a dampening agent catch rod, which is situated at a defined small distance from the dampening ductor, are positioned parallel to the dampening ductor or roller.

DE 94 20 343 U1 shows a dampening system, whose dampening agent tank has an inflow line with several openings. A return conduit, having a weir, extends over the entire length of the dampening agent tank.

DE 199 09 262 A1 describes a dampening agent tank with a dam for limiting the return flow of the dampening agent. A filter has been installed between this dam and a return flow line.

DE 38 31 741 A1 discloses a dampening agent tank with several inflow lines and with several return flow lines.

DE 17 61 908 A discloses an adjustable dampening supply device.

SUMMARY OF THE INVENTION

The object of the present invention is directed to providing dampening systems with dampening agent inflow and return flow devices.

In accordance with the present invention, the object is attained by the provision of a dampening system having at least one dampening fluid ductor or roller, a dampening agent tank, an inflow device and a return flow device. The inflow device has several distributing tubes, each typically with several openings, that are assigned to the ductor. At least one inflow line of the distributing tube is arranged between last openings of first and second ends of the distributing tube. The return flow device has a collecting tank that is connected with the dampening agent tank, which collecting tank extends in the longitudinal direction of the ductor and is double walled.

The advantages to be gained by the present invention consist, in particular, in that the dampening ductor or roller is arranged in the dampening agent tank between the inflow device and the return flow device for the dampening agent. The inflow device and the return flow device are configured in such a way that the inflow and the return flow of the dampening agent in the area of the dampening ductor are both distributed to several locations. In the course of conducting new or fresh dampening agent from a dampening agent reservoir to the dampening agent tank, uneven intermixing of newly supplied dampening agent with dampening agent already present in the dampening agent tank can occur at some locations in the dampening agent tank. Areas of the dampening agent tank, in which little intermixing takes place, can heat up and can have a temperature which is higher, by up to 10° C., in comparison with areas of the dampening agent tank in which a constant exchange between newly supplied dampening agent with the dampening agent already present in the dampening agent tank takes place. Since the viscosity of the dampening agent depends greatly on the temperature of the dampening agent, and since the print quality, in turn, depends greatly on the viscosity of the dampening agent, the dampening agent taken up from the tank by the dampening ductor must be substantially at the same temperature level over the entire length of the dampening ductor.

The present invention is directed to the provision of a dampening system wherein a uniform exchange of dampening agent takes place substantially over the entire length of the area of the dampening ductor.

This objective is achieved in accordance with the present invention because several locations for the inflow of dampening agent, called dampening agent inflow locations, are assigned to the front of the dampening ductor, and several locations for the return of dampening agent, called dampening agent return flow locations, are assigned to the rear of the dampening ductor. Thus, the dampening ductor is located in the area of a flow of dampening agent which is formed by both the inflow and the return flow of the dampening agent into or out of the dampening agent tank.

The locations for the inflow and for the return flow are matched to each other in such a way that a uniform intermixing of newly supplied dampening agent with that already present in the dampening agent tank takes place in the area of the dampening ductor and over its entire roller length. In this way, it is possible, for example, to match the spatial arrangement of the inflow and return flow locations among or between each other.

A further possibility resides in the configuration of the inflow and of the return flow locations themselves, such as, for example, their geometry, shape and/or diameter. It would also be possible to cause uniform intermixing by a suitable distribution of the charging pressure at the dampening agent inflow locations. In actual use, a combination of these various possibilities will result, wherein the actual configuration will have to be determined by empirical tests. In connection with the principle of uniform intermixing of dampening agent, such as water, in the area of the dampening doctor blade over its entire length, it is important that, on the one hand, that dampening agent is supplied at several locations in the area of the dampening ductor and, on the other hand, dampening agent is returned at several locations in the area of the dampening doctor blade in order to assure a continuous exchange of dampening agent in the area of the dampening ductor.

In accordance with a preferred embodiment of the present invention, the dampening agent inflow device is arranged at the dampening agent tank as a separate component. This is of particular advantage if the inflow device must periodically be disassembled, for example because it has become damaged or dirty. In the present case, it is then possible to remove the inflow device, embodied as a separate component, in a simple and cost-effective manner from the dampening agent tank. Thus, a more cost-intensive disassembly of the entire dampening agent tank is not necessary.

The dampening agent inflow line is attached substantially at the center of the inflow device. This has the advantage that, following the charging of the inflow line with dampening agent, an almost identical dampening agent pressure prevails at all of the dampening agent inflow locations of the inflow device. In this way, a pressure drop, as is the case when the inflow line is located on one side of the inflow device, is clearly reduced.

To minimize interference effects of the dampening agent flow in the dampening agent tank, it would be sensible to arrange the tubes of the dampening agent inflow line at the side of the dampening agent tank. At the same time, it is conceivable to use the inflow line as a support for the inflow device. This allows a simple and a cost-effective configuration of the inflow line and the inflow device.

It is of no importance, for the principle of the invention, in which way the inflow device is configured. It is thus possible, for example, to configure the inflow device as a hollow conductor, such as a round tube, for example.

To provide dampening agent to the dampening agent tank, uniformly distributed over the entire length of the dampening ductor, it is practical for the dampening agent inflow locations, which are embodied as either circular or rectangular cutouts, to be arranged over the entire length of the hollow conductor and to be evenly spaced apart from each other. A further possibility lies in providing a rectangular cutout for the passage of the dampening agent in the hollow conductor, which rectangular cutout extends substantially over the entire length of the hollow conductor.

In connection with dampening ductors of great length it is not as possible to provide a uniform pressure at all of the dampening agent inflow locations available, even with a central inflow of the dampening agent into the inflow device, which is embodied as a hollow conductor. In this case, it would be sensible for the inflow device to consist of at least two hollow conductors, which are arranged one behind the other in the longitudinal direction. Each one of these hollow conductors may be separately provided with dampening agent by the use of an inflow line and wherein the two hollow conductors are functionally separated from each other.

In accordance with a further preferred embodiment, the return flow device consists of at least two cutouts which are arranged in the bottom of the dampening agent tank, and through which the dampening agent can be returned from the dampening agent tank to the dampening agent reservoir. To achieve a uniform removal of the dampening agent from the dampening agent tank it would furthermore be appropriate to arrange the cutouts so that they are parallel with respect to the longitudinal axis of the dampening ductor. A return flow device configured in this way can be accomplished in a particularly simple and cost-effective manner.

It is particularly advantageous, in accordance with the present invention, if the return flow device has a comb-shaped component which is arranged upstream of the cutouts in the bottom of the dampening agent tank. The comb shape of the component is constituted by alternating areas of tooth-shaped elevations and indentations, wherein a cutout in the bottom of the dampening agent tank is assigned to each indentation area. The comb-shaped component is arranged parallel with respect to the longitudinal axis of the dampening ductor. The comb-shaped component extends over the entire length of the dampening doctor blade, and the tooth-shaped elevations point vertically upward. A type of increase of the cross section of this area is accomplished by the provision of the indentations, because of which increase the dampening agent can preferably flow into the cutouts arranged downstream of the indentations and is removed in this way, from the dampening doctor blade over the entire length of the latter.

Due to the large temperature difference between the dampening agent and the ambient air it would be prudent to configure the lines for the inflow and for the return flow of the dampening agent into or out of the dampening agent reservoir to be double-walled to achieve some sort of thermal disconnection between the lines conducting dampening agent and the ambient air. Without a thermal disconnection, any moisture contained in the air can condense on the lines charged with dampening agent. Drops of condensate are formed, which drops can settle, for example, in the area of the printing group and/or onto the web of material to be imprinted, which drops can also lead to interference with the printing operation.

The hollow space of the double-walled inflow and return flow lines is filled with an insulative foam.

To match the temperature of the new dampening agent supplied from the dampening agent reservoir, in particular in such a way that the dampening agent received on the dampening doctor blade over its entire length has substantially the same temperature, it would be beneficial for a temperature measuring device to be provided in the area of the dampening agent doctor blade in at least two locations. The temperature measuring device can be coupled with a control and/or with a regulating device, by the use of which, the temperature of the supplied dampening agent is regulated.

BRIEF DESCRIPTION OF THE DRAWINGS

Preferred embodiments of the present invention are represented in the drawings and will be described in what follows.

Shown are in.

DESCRIPTION OF THE PREFERRED EMBODIMENTS

Figure 1:
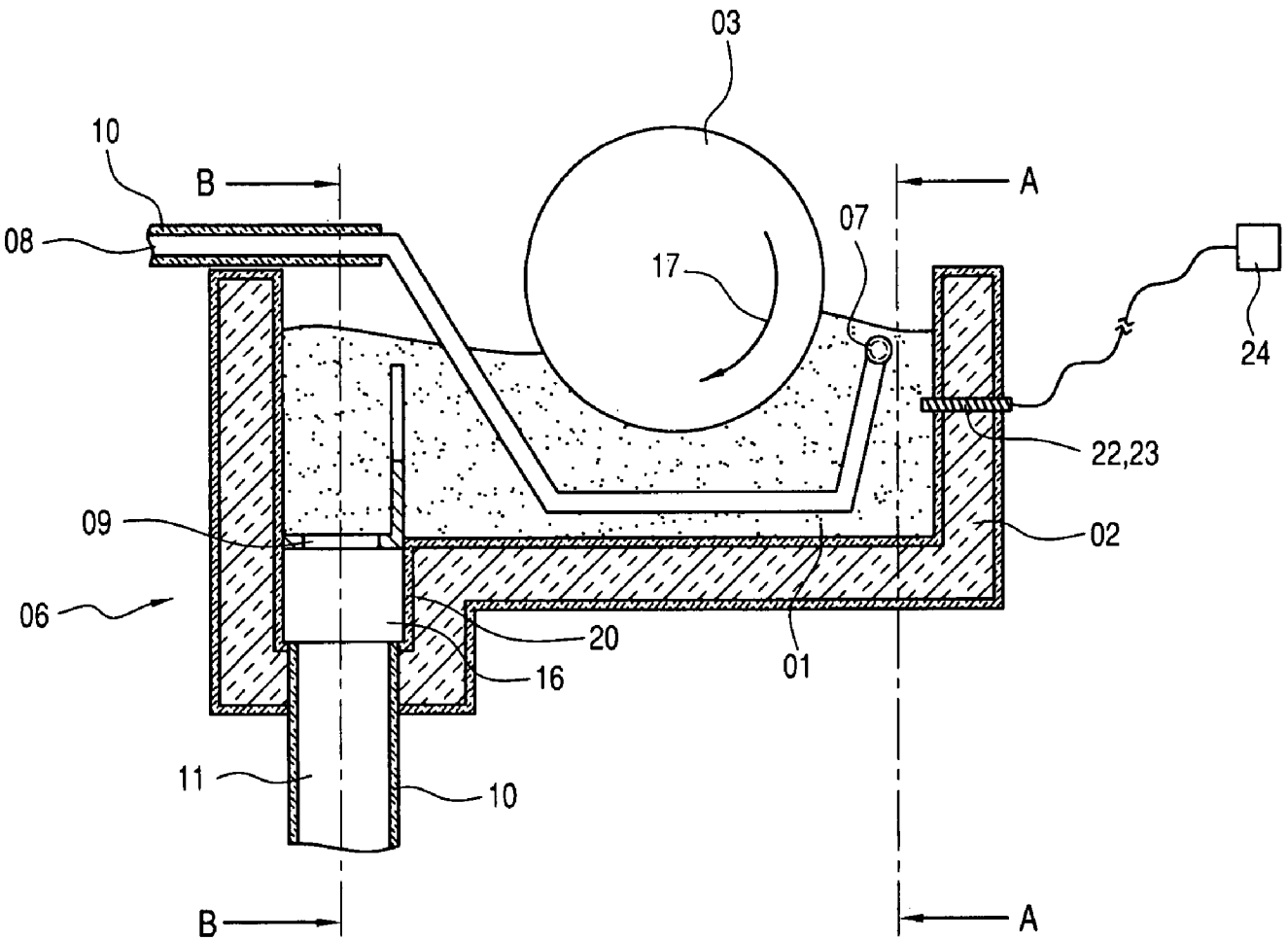
FIG. 1, a side elevation view, partly in cross-section, of a preferred embodiment of a dampening system with a dampening agent tank, a dampening ductor and devices for the inflow and return flow of dampening agent in accordance with the present invention, in FIG. 2, a front view, partly in cross-section, of a first preferred embodiment of a dampening system in accordance with FIG. 1 and taken in the sectional direction A shown in FIG. 1, and without the comb-shaped component, in FIG. 3, a front view, partly in cross-section of a dampening system in accordance with FIG. 1 in the sectional direction B shown in FIG. 1 and without the dampening ductor, and in FIG. 4. a front view, partly in cross-section of a second preferred embodiment of a dampening system in accordance with the present invention, also taken in the sectional direction as shown in FIG. 1 and without the comb-shaped component.
Figure 2:
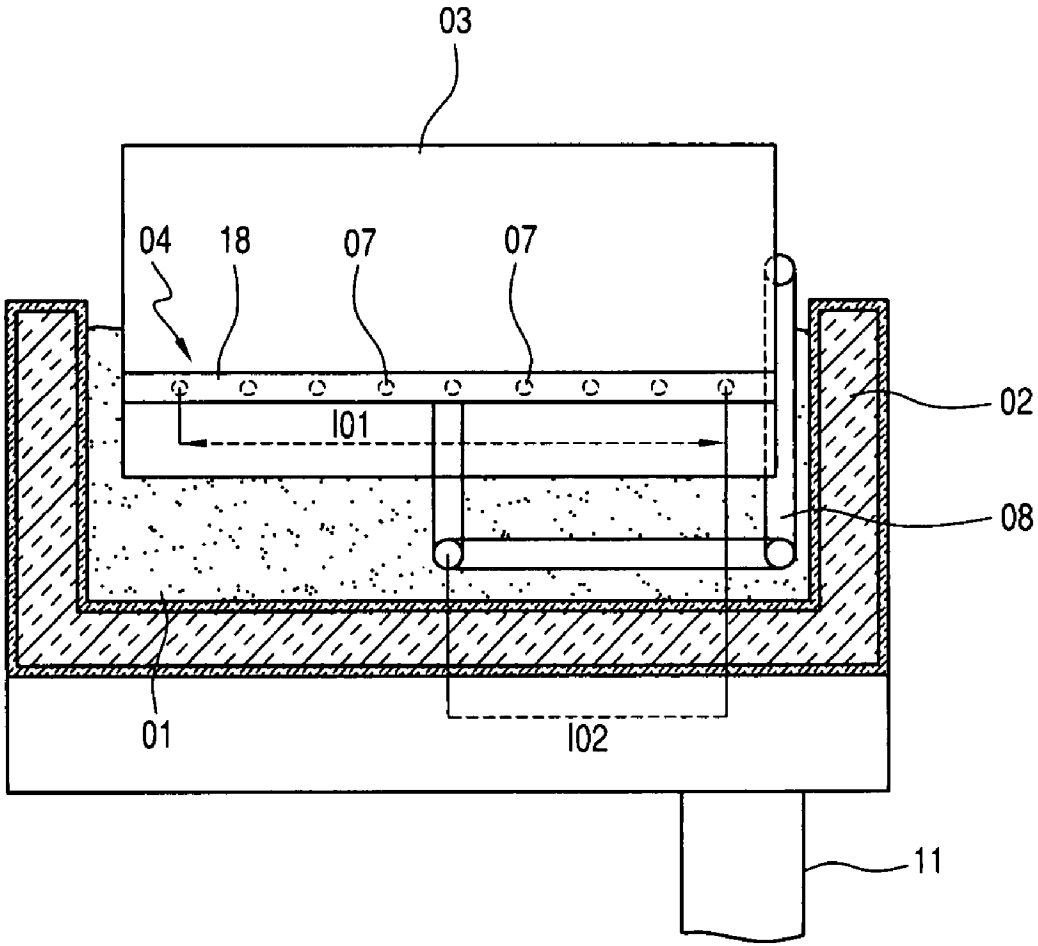

A dampening system in accordance with the present invention, with devices for accomplishing the inflow and the return flow of a dampening agent 01 into or out of a dampening agent tank 02, is represented in FIG. 1. A dampening ductor or roller 03 is attached between an inflow device 04, as seen in FIG. 2, and a return flow device 06. The inflow device 04 is arranged opposite the front side of the dampening ductor 03.

For improved understanding it should be pointed out at this juncture that the inflow device 04 consists of at least one distributing tube 18 with several openings 07. This is shown most clearly in FIG. 2 and also in FIG. 4 which shows two such distributing tubes 18, each with several openings 07.

In the present preferred embodiment, each distributing tube 18 is provided as a separate component in the dampening agent tank 02, as represented in FIG. 2 and in FIG. 4, and is preferably substantially located completely below the liquid level of the dampening agent 01. Moreover, each distributing tube 18 is embodied as a hollow conductor 18 in the form of a round tube 18 and has an interior tube diameter of approximately 10 mm to 20 mm, and in particular has a diameter of 12 mm. A longitudinal axis of each distributing tube 18 extends parallel with a longitudinal axis of the dampening ductor 03. The length of the distributing tube or the distributing tubes 18 extends substantially over the length of the dampening ductor 03.

As can also be seen by referring to FIG. 2, the dampening agent inflow locations 07, which are embodied as circular cutouts 07, are arranged over the entire length of the distributing tube 18. These circular cutouts 07 point or face in a direction toward the dampening ductor 03. By charging the distributing tube 18 with dampening agent 01, this dampening agent 01 can then exit through the dampening agent inflow locations 07, so that dampening agent 01 is supplied to the dampening agent tank 02 substantially over the entire length of the dampening ductor 03. The distal ends of the distributing tube 18 are each closed, so that no dampening agent 01 can flow out of them. In the present preferred embodiment, the circular cutouts 07 are spaced at equal distances from each other and all have the same diameter. The diameter of each of the circular cutouts 07 lies, for example, within a range of from 1 mm to 5 mm, and is, in particular, 3 mm.

The cross section or area of each of the circular cutouts 07 corresponds to approximately 25% of the diameter of the round tube 18.

The flow path of the dampening agent 01 between the distributing tube or tubes 18 and the dampening ductor 03 is identical over the entire length of the dampening ductor 03 because of the parallel orientation of the dampening ductor 03 and the distributing tube or tubes 18. Because the plurality of dampening agent inflow locations 07 are arranged opposite the dampening ductor 03 over substantially its total length, it is possible to supply the dampening agent tank 02 uniformly with dampening agent 01 over substantially the entire length of the dampening ductor 03.

Each distributing tube 18 is provided with dampening agent 01 from a dampening agent reservoir, which is not specifically represented, through an inflow line 08. As seen in FIG. 1, this inflow line 08 can be a double-walled hollow conductor filled with an insulative foam 10. To achieve a substantially uniform pressure of the newly supplied dampening agent 01 arriving at all of the dampening agent inflow locations 07 of each distributing tube 18, embodied as a round tube 18, and flowing into the dampening agent tank 02 to mix with the dampening agent 01 already in tank 02, each inflow line 08 is arranged centered along the length of its associated distributing tube 18. In contrast to a one-sided inflow of the dampening agent 01 into the distributing tube 18, with the length of the distributing tube 18 being the same, the dampening agent 01 travels over a substantially shorter flow path before exiting through the dampening agent inflow locations 07. Moreover, with the inflow line 08 arranged in the center of the distributing tube 18, and with an identical number of dampening agent inflow locations 07, only approximately half as many of the dampening agent inflow locations 07 are arranged in series one behind the other in comparison to the orientation that would exist in a one-sided inflow. Because of this configuration, a considerably reduced pressure difference between dampening agent inflow locations 07 spaced far apart from each other, and thereby a substantially identical pressure of the outflowing dampening agent, can be achieved at all dampening agent inflow locations 07.

In the present preferred embodiment, the dampening agent inflow line 08 is embodied in the form of a bent round tube 08, which is either of one piece construction, or which can consist of several components, which are, for example screwed together, welded together or hard-soldered. The connection between the distributing tube 18 and the inflow line 08 can also be provided by a screw connection, a welded connection or a hard-soldered connection. The inflow line 08 at the same time takes on the function of a support for the distributing tube 18, so that a separate frame for holding the distributing tube 18 in the dampening agent tank 02 can be omitted. In order not to negatively affect the essential function of the dampening system, which could be the case if, for example, the flow of the dampening agent 01 through the tubes of the inflow line 08 were interfered with, the inflow line 08 runs on the side of the dampening agent tank 02 adjacent the bottom of the dampening agent tank 02.

Figure 4:
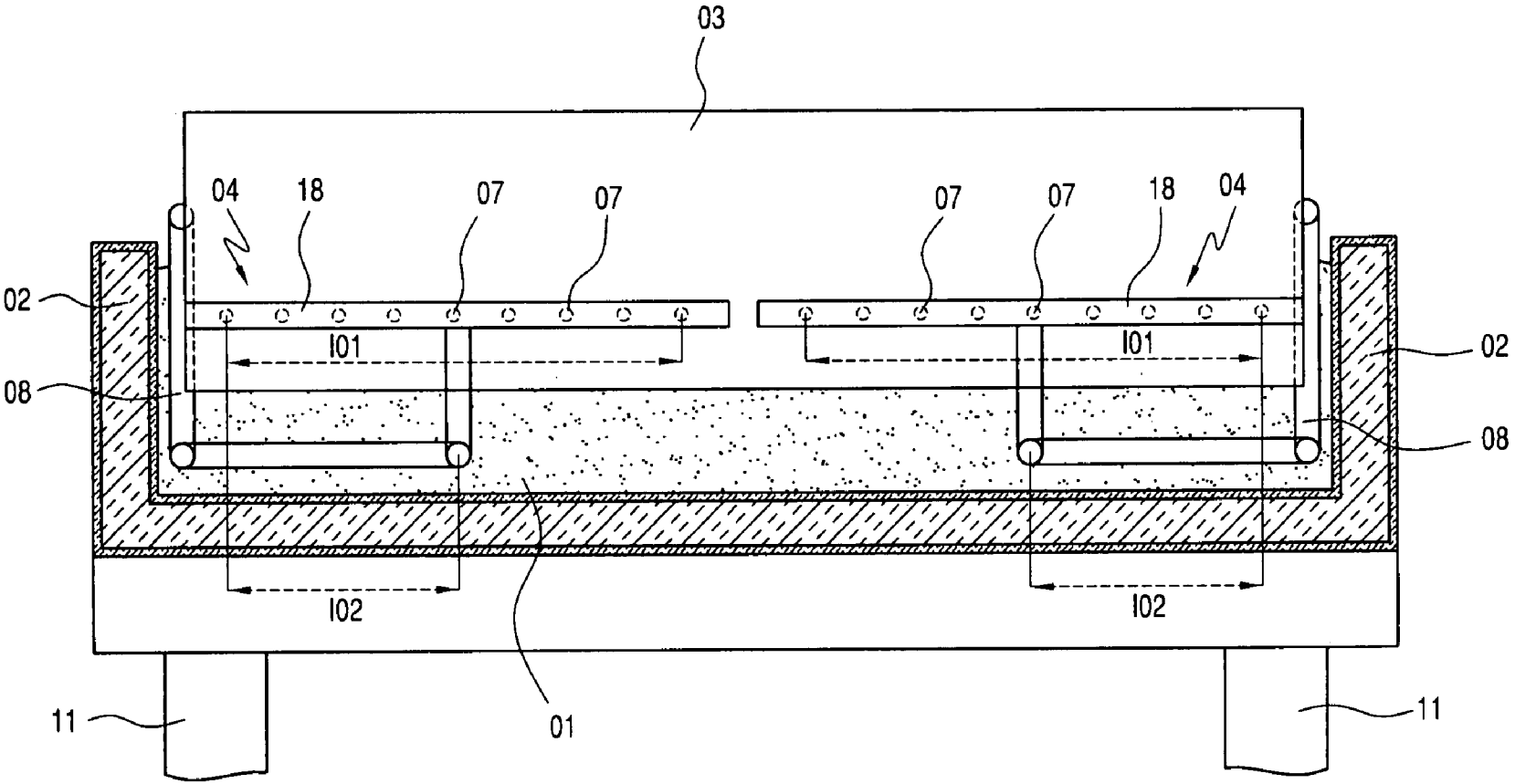

In a further preferred embodiment, which is represented in FIG. 4, several distributing tubes 18 can be assigned to the dampening ductor 03. Each one of these several distributing tubes 18 has its own inflow line 08.

At least one inflow line 08 of the distributing tube 18 is arranged between a last opening 07 of a first distal end and a last opening 07 of a second distal end of the distributing tube 18. The inflow line 08 is, in particular centered along the length of the distributing tube 18. In the case of several inflow lines 08 for a single distributing tube 18, these several inflow lines 18 are arranged approximately uniformly distributed in relation to the longitudinal direction of the distributing tube 18.

The two last openings 07 of the distal ends of the distributing tube 18 are spaced at a distance I01 from each other, as seen in FIG. 2. A further distance 102 is defined between the last opening 07 and the inflow line 08.

The following relationship applies: $I02 = {}^{I01}/_{N+1}$, wherein N is the number of inflow lines 08, and I01 is the spacing between the two last openings of the distributing tube 18.

For a distance I03 between two inflow lines 08 the following applies: $I03 \neq {}^{I01}/_{N+1}$, wherein N is the number of inflow lines 08, and I01 is the spacing between the two last openings of the distributing tube 18.

The openings 07 of the distributing tube 18 are arranged below the surface level of the dampening agent 01 in the dampening agent tank 01, i.e. within the body of the dampening agent 01. The inflow lines 08 are also arranged, from the side of the dampening agent tank 02 to the center of the distributing tube 18, within the dampening agent 01.

The inflow line 08 of each distributing tube 18 is arranged, at least in part, in the longitudinal direction of the dampening ductor 03 within the dampening agent. This may be seen most clearly in FIG. 2 and also in FIG. 4.

The return flow device 06 has a double-walled collecting tank 16. Collecting tank 16 is connected with the dampening agent tank 02 and extends in the longitudinal direction of the dampening ductor or roller 03, as is seen in FIG. 1. This longitudinal extension of the collecting tank 16 can also be seen in FIG. 3.

The return flow device 06 is arranged in the dampening agent tank 02 opposite to the rear of the dampening ductor 03. In the depicted embodiment, the return flow device 06 consists of two components, namely cutouts 09 which are located in the bottom of the dampening agent tank 02 for the return flow of the dampening agent 01 which was carried out of the area of the dampening ductor 03, and a comb-shaped component 12, which has been placed upstream of the cutouts 09. The cutouts 09, which may be formed as circles, have a diameter of from 10 mm to 30 mm, and in particular of 23 mm. The comb-shaped component 12 is oriented parallel with the longitudinal axis of the dampening ductor 03 and extends over the entire width of the dampening agent tank 02. In the same way, the downstream located cutouts 09, formed on the bottom of the dampening agent tank 02, are also arranged parallel with the longitudinal axis of the dampening ductor 03 and extend substantially over the entire length of the dampening ductor 03.

Figure 3:
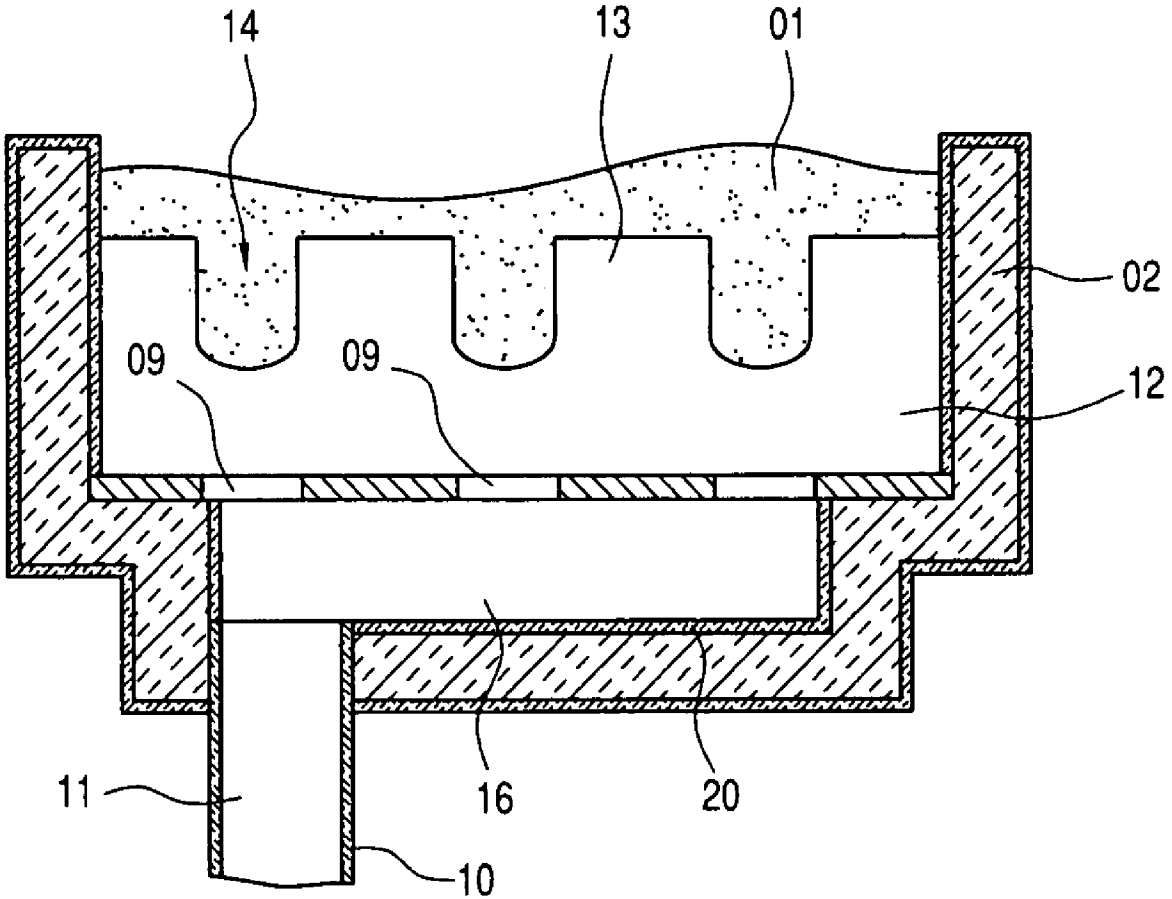

The dampening system, in the area of the return flow device 06, is represented in FIG. 3, in the cross-sectional direction B and without the dampening ductor 03. The comb-shaped component 12 and the cutouts 09 arranged in the bottom of the dampening agent tank 02 can be seen in this cross-sectional front elevation view. The comb-shaped component 12 is mounted on the bottom of the dampening agent tank 02 and is oriented perpendicularly with respect to it. In the present preferred embodiment, the comb-shaped component 12 is embodied in the form of a comb plate 12 with tooth-shaped elevations 13. The tooth-shaped elevations 13 each have a linear extension of from 100 mm to 300 mm, in particular of 200 mm. The elevations 13, in the form of teeth, are formed so that dampening agent return flow locations 14, which are substantially embodied by incisions 14, formed in the top of the comb-shaped plate 12, are open at the top of plate 12 and are extending parallel to each other, and with rectangular and/or triangular and/or curved bottom transitions. The incisions 14, as well as the alternating tooth-shaped elevations 13, are located below the liquid level of the dampening agent 01 in the dampening agent tank 02. The dampening agent 01 coming from the dampening ductor 03 can flow out of the tank 02 over the entire length of the comb-shaped component 12. However, a sort of a cross-sectional flow volume increase takes place in the area of each incision 14, because of which flow volume increase, flowing off dampening agent 01 is conducted out of the area of the dampening ductor 03 preferably in the respective areas of the incisions 14. A separate cut-out 09 in the bottom of the dampening agent tank 02 is assigned downstream of each incision 14 in the comb plate 12, and through which cut-out 09 the dampening agent 01 is conducted out of the dampening agent tank 02 into a collecting tank 16. It is assured by this that in the area of each incision 14, the dampening agent 01 can flow off unhindered. The dampening agent 01 that flows out of the dampening agent tank 02, is returned from the collecting tank 16 to the dampening agent reservoir through one return line 11, as seen in FIG. 2, or through two such return lines 11, as seen in FIG. 4. Each such return line 11 is also a double-walled line with the hollow space being filled with insulative foam 10, in a manner similar to that which was discussed previously in connection with each inflow line 08. The collecting tank 16 extends in the longitudinal direction of the dampening ductor 03, as seen in FIG. 3, and extends, in the transverse direction of the tank 02 and the ductor 03, at a fraction of the width of the dampening agent tank 02. The collecting tank 16 has double walls defining a space which is filled with an insulative foam 20, as seen in FIGS. 1 and 3. The incisions 14 in the comb plate 12, as well as the cutouts 09 in the bottom of the dampening agent tank 02, are spaced apart from each other at equal distances and extend over the entire length of the dampening ductor 03. The distance between the tooth-shaped elevations 13 is from 1 mm to 20 mm, and in particular is 5 mm. By the arrangement of the incisions 14 in the comb plate 12 and by the respectively arranged downstream cutouts 09 in the bottom of the dampening agent tank 02, it is possible to remove dampening agent 01 from the area of the dampening ductor 03 substantially over the entire length of the dampening ductor 03.

Analogous to the geometric conditions in the area of the inflow device 04, the return flow path of the dampening agent 01 between the dampening ductor 03 and the return flow device 06 is also uniform over the entire length of the dampening ductor 03. This is because of the parallel arrangement of the dampening ductor 03 and the return flow device 06. Because the dampening agent return flow locations 09, 14 are arranged opposite each other, over substantially the entire length of the dampening ductor 03, dampening agent 01, coming from the direction of the dampening ductor 03, can be removed from the area of the dampening ductor 03 uniformly over the entire length of the dampening ductor 03.

Since the longitudinal axes of the inflow device 04 and of the return flow device 06 extend substantially parallel with respect to the longitudinal axis of the dampening ductor 03, and to each other, and because the dampening agent inflow locations 07 are arranged on the front and dampening agent return flow locations 09, 14 are arranged on the back of, and substantially opposite the dampening ductor 03, and extending over the entire length of the dampening ductor 03, and further because of the substantially uniform charging with pressure of all of dampening agent inflow locations 07, it is possible, in a simple way, in accordance with the present invention, to supply dampening agent 01 to the dampening ductor 03 over its entire length and to uniformly remove dampening agent 01. This means that identical flow conditions prevail for both inflowing and outflowing dampening agent 01 over the entire roller length, so that a uniform intermixing of freshly supplied, inflowing dampening agent 01, with dampening agent 01 already present in the dampening agent tank 02 can take place over the entire roller length. A uniform exchange of dampening agent 01 is thus assured over the entire roller length. The uniform, equal exchange of dampening agent 01 is additionally aided by setting the direction of rotation 17 of the dampening ductor 03 to be the same as the flow direction of the dampening agent 01, as seen in FIG. 1. Because of the even intermixing of new, inflowing dampening agent with dampening agent 01 already present in the dampening agent tank 02, the dampening agent 01 picked up by the dampening ductor 03 has identical physical and chemical properties over the entire length of the dampening ductor 03. In addition, to match the temperature of the new dampening agent supplied from the dampening agent reservoir, temperature measuring devices 22, 23 are provided in the area of the dampening agent doctor blade 03 in at least two locations, as seen in FIG. 1. The temperature measuring devices 22, 23 are coupled with a control or regulating device 24. The temperature of the dampening fluid can be regulated or controlled using the control or regulating device 24 in response to the dampening fluid temperature measured by the temperature measuring devices 22, 23.

In place of the cutouts 09 in the bottom of the dampening agent tank 02, it is also possible to, for example, arrange an additional separating wall, with cutouts 09, between the dampening agent tank 02 and the collecting tank 16.

The size of the inflow and of the return flow at the respective dampening agent inflow locations 07 and at the dampening agent return flow locations 09, 14 can be adjusted.

While preferred embodiments of dampening systems having a dampening agent feeding and return device, in accordance with the present invention, are set forth fully and completely hereinabove, it will be apparent to one of skill in the art that various changes in, for example, a drive source for the ductor, the specific constituency of the dampening fluid, and the like could be made without departing from the true spirit and scope of the present invention which is accordingly to be limited only by the following claims.

What is claimed is:

1. A dampening system comprising:

at least one dampening ductor;

a dampening agent tank adapted to receive dampening agent to be applied to said at least one dampening ductor;

a dampening agent inflow device adapted to supply dampening agent to said tank;

a return flow device adapted to remove dampening agent from said tank at least first and second dampening agent distributing tubes in said inflow device;

a plurality of openings in each of said at least first and second dampening agent distributing tubes, with each said opening tube facing said dampening ductor;

an inflow line connected to each of said at least first and second dampening agent distributing tubes and;

first and second spaced tube ends on each of said at least first and second dampening agent distributing tubes, last ones of said plurality of openings in each said dampening agent distributing tube being adjacent said first and second spaced tube end of each said dampening agent distributing tube, said inflow line for each said dampening agent distributing tube being connected to said tube intermediate said first and second spaced tube ends.

2. The dampening system of claim 1 wherein each said inflow line is connected to each said dampening agent distributing tube approximately centered in respect to a longitudinal direction of said distributing tube.

3. The dampening system of claim 1 including more than one inflow line connected to each said distributing tube uniformly distributed in respect to a longitudinal direction of each said distributing tube.

4. The dampening system of claim 1 wherein said last ones of said openings have of first spacing distance l 01, wherein N is a number of said inflow lines and wherein a second spacing distance l 02 between said last one of said openings and an adjacent one of said inflow lines is not equal to $^{l\ 01}/_{N+1}$.

5. The dampening system of claim 1 further including wherein a distance l 03 between two adjacent one of said spaced inflow lines is equal to a first spacing distance l 01 between said last ones of said openings divided by a number of said inflow lines plus I ; l 03 $=^{l\ 01}/_{N+1}$.

6. The dampening system of claim 1 including dampening agent in said dampening agent tank and wherein said plurality openings are below a surface level of said dampening agent.

7. The dampening system of claim 1 further wherein said return flow device has a collecting tank connected to said dampening agent tank and extending in a longitudinal direction of said dampening ductor, said collecting tank being a double walled tank.

8. The dampening system of claim 7 wherein said dampening ductor is arranged between said inflow device and said return flow device and further wherein inflow of dampening agent occurs at several dampening agent inflow locations and return flow of dampening agent takes place at several dampening agent outflow locations of said return flow device.

9. The dampening system of claim 8 wherein said dampening agent outflow locations are arranged over a length of said dampening ductor.

10. The dampening system of claim 8 wherein said several dampening agent outflow locations of said return flow device are spaced at equal spacing distances.

11. The dampening system of claim 7 wherein said dampening ductor has a first longitudinal axis and said return flow device has a third longitudinal axis parallel to said first longitudinal axis.

12. The dampening system of claim 7 including means for adjusting an amount of dampening agent removal at said return flow device.

13. The dampening system of claim 7 wherein said inflow device is arranged below a level of a dampening agent in said dampening agent tank.

14. The dampening system of claim 1 wherein said plurality of openings define a plurality of dampening agent inflow locations spaced along a length of said dampening ductor.

15. The dampening system of claim 1 wherein said plurality of openings are spaced at equal spacing distances along said at least first and second distributing tubes.

16. The dampening system of claim 1 wherein said dampening ductor has a first longitudinal axis and wherein said inflow device has a second longitudinal axis which is parallel to said first longitudinal axis.

17. The dampening system of claim 1 further including a flow direction of said dampening agent in said dampening agent tank from said inflow device to said return flow device, and wherein said dampening ductor has a direction of rotation the same as said flow direction.

18. The dampening system of claim 1 including means for adjusting an amount of dampening agent inflow at said dampening agent inflow device.

19. The dampening system of claim 1 wherein said inflow device is a separate component of said dampening agent tank.

20. The dampening system of claim 1 wherein each said inflow line is attached centered on its respective one of said at least first and second dampening agent distributing tubes in said inflow device.

21. The dampening system of claim 1 wherein each said inflow line leads out of a side of said dampening agent tank.

22. The dampening system of claim 1 wherein each said inflow line is adapted to support its respective one of said at least first and second dampening agent distributing tubes in said inflow device in said dampening agent tank.

23. The dampening system of claim 1 wherein each said inflow line is double-walled.

24. The dampening system of claim 23 further including a hollow chamber between first and second walls of said double-walled inflow line, and insulative foam in said hollow chamber.

25. The dampening system of claim 1 wherein each said inflow line is a hollow conductor.

26. The dampening system of claim 25 wherein each said hollow conductor is a round tube.

27. The dampening system of claim 26 wherein each said round tube has a diameter of 10 mm to 20 mm.

28. The dampening system of claim 1 wherein each said opening is a round cutout.

29. The dampening system of claim 28 wherein each said round cutout has a diameter from 1 mm to 5 mm.

30. The dampening system of claim 28 wherein each said round cutout is spaced by 20 mm to 30 mm from each other round cutout.

31. The dampening system of claim 1 wherein each said opening is rectangular.

32. The dampening system of claim 1 wherein said plurality of said openings are evenly spaced and arranged along each said dampening agent distributing tube.

33. The dampening system of claim 1 wherein each of said openings has an area and wherein each of said at least first and second distributing tubes has a diameter, said opening area for each said opening equals 25% of said distributing tube diameter.

34. The dampening system of claim 1 wherein said return flow device includes at least two cutouts in a bottom of said dampening agent tank and which cutouts extend in a longitudinal direction of said dampening ductor.

35. The dampening system of claim 34 wherein said return flow device cutouts are circular.

36. The dampening system of claim 35 wherein each of said circular return flow device cutouts has a diameter of 10 mm to 30 mm.

37. The dampening system of claim 1 further including a comb-shaped component in said return flow device and having tooth-shaped elevations, said comb-shaped component extending parallel with a longitudinal axis of said dampening ductor and having a length the same as said dampening ductor.

38. The dampening system of claim 37 wherein said comb-shaped component is secured to a bottom of said dampening agent tank with said tooth-shaped elevations pointing upward.

39. The dampening system of claim 37 wherein said tooth-shaped elevations are one of rectangular, triangular and curved.

40. The dampening system of claim 37 wherein said comb-shaped component is a comb plate.

41. The dampening system of claim 37 wherein said tooth-shaped elevations have a longitudinal extension of 100 mm to 300 mm.

42. The dampening system of claim 37 wherein said tooth-shaped elevations are spaced apart by 1 mm to 20 mm.

43. The dampening system of claim 1 further including a return flow line in said return flow device, said return flow line being double-walled.

44. The dampening system of claim 43 further including a hollow space between first and second spaced walls in said return flow line and insulative foam in said hollow space.

45. The dampening system of claim 1 further including at least first and second temperature measuring devices adapted to determine a dampening agent temperature adjacent said dampening ductor.

46. The dampening system of claim 1 further including dampening agent temperature regulating means.

47. The dampening system of claim 1 further including a collecting tank in said return flow device, said collecting tank being connected with said dampening agent tank.

48. The dampening system of claim 47 wherein said collecting tank extends in a longitudinal direction of said dampening agent tank, said collecting tank having a width less than a width of said dampening agent tank.

49. The dampening system of claim 47 wherein said collecting tank is double-walled.

50. The dampening system of claim 49 wherein said collecting tank has spaced walls defining a hollow space, said hollow space receiving insulative foam.

51. A dampening system comprising:

at least one dampening ductor:

a dampening agent tank adapted to receive dampening agent to be applied to said at least one dampening ductor:

a dampening agent inflow device adapted to supply dampening agent to said tank;

a return flow device adapted to remove dampening agent from said tank;

at least one dampening agent distributing tube in said inflow device:

a plurality of openings in said at least one distributing tube and facing said dampening ductor;

an inflow line connected to said at least one distributing tube; and first and second tube ends on said at least one distributing tube, last ones of said plurality of openings being adjacent each of said first and second tube ends, said inflow line being connected to said distributing tube intermediate said last openings, said inflow line being at least partially arranged in said dampening agent in said dampening agent tank and extending in a longitudinal direction of said dampening ductor.

52. The dampening system of claim 51 wherein said inflow line extends from a side of said dampening agent tank to a center of said distributing tube.

* * * * *